US009481181B2

(12) United States Patent
Qin

(10) Patent No.: US 9,481,181 B2
(45) Date of Patent: Nov. 1, 2016

(54) INK CARTRIDGE CHIP, INK CARTRIDGE, AND STRUCTURAL BODY

(71) Applicant: ZHUHAI NINESTAR MANAGEMENT CO., LTD., Zhuhai (CN)

(72) Inventor: Lei Qin, Zhuhai (CN)

(73) Assignee: ZHUHAI NINESTAR MANAGEMENT CO., LTD., Guangdong (CN)

( * ) Notice: Subject to any disclaimer, the term of this patent is extended or adjusted under 35 U.S.C. 154(b) by 0 days.

(21) Appl. No.: 14/942,820

(22) Filed: Nov. 16, 2015

(65) Prior Publication Data

US 2016/0067977 A1 Mar. 10, 2016

Related U.S. Application Data

(63) Continuation of application No. PCT/CN2013/089257, filed on Dec. 12, 2013.

(30) Foreign Application Priority Data

May 17, 2013 (CN) ..... 2013 1 0186055

(51) Int. Cl.
*B41J 2/175* (2006.01)

(52) U.S. Cl.
CPC ..... *B41J 2/1753* (2013.01); *B41J 2/17546* (2013.01)

(58) Field of Classification Search
CPC B41J 2/1752; B41J 2/17526; B41J 2/17533; B41J 2/17536; B41J 2/17546; B41J 2/17553; B41J 2/14072
See application file for complete search history.

(56) References Cited

U.S. PATENT DOCUMENTS 5,506,611 A * 4/1996 Ujita ..... B41J 2/17503 347/19
6,000,773 A 12/1999 Murray et al. ..... 347/7
(Continued)

FOREIGN PATENT DOCUMENTS

CN 201856452 U 6/2011
CN 102381045 A 3/2012
(Continued)

OTHER PUBLICATIONS

International Search Report of corresponding International PCT application No. PCT/CN2013/089257, dated Jan. 30, 2014.
(Continued)

*Primary Examiner* — Juanita D Jackson
(74) *Attorney, Agent, or Firm* — J.C. Patents

(57) ABSTRACT

Disclosed are an ink cartridge chip (200), an ink cartridge (400), and a structural body (700). The ink cartridge chip comprises a circuit board (201) and at least two container side terminals (202) for contacting apparatus side terminals (500). The circuit board comprises a first plane (203) and a second plane (204) perpendicularly intersecting with the first plane. The second plane has a surface area smaller than the first plane. The container side terminals are disposed on the second plane with the smaller surface area, with one ends intersecting with the first plane, and the other ends intersecting with a third plane opposite to the first plane. The container side terminals extend through the second plane and are arranged into a row, so that it may easily contact the apparatus side terminals, thereby improving the stability of an electrical connection between an ink cartridge and a printer.

15 Claims, 8 Drawing Sheets

(56) References Cited

U.S. PATENT DOCUMENTS

| | | | | |
|---|---|---|---|---|
| 6,588,871 | B2 | 7/2003 | Studholme et al. | 347/19 |
| 2005/0093942 | A1 | 5/2005 | Kawamura et al. | 347/86 |

FOREIGN PATENT DOCUMENTS

| | | | |
|---|---|---|---|
| CN | 202463198 | U | 10/2012 |
| CN | 202862815 | U | 4/2013 |
| CN | 103101317 | A | 5/2013 |
| CN | 203358049 | U | 12/2013 |
| EP | 1 004 448 | A2 | 5/2000 |
| EP | 1 179 431 | A1 | 2/2002 |
| EP | 1 219 437 | A2 | 7/2002 |
| JP | 2009-90668 | A | 4/2009 |

OTHER PUBLICATIONS

Chinese First Examination Report of corresponding China patent application No. 201310186055.1, dated Jun. 30, 2015.

The extended European Search Report of corresponding European patent application No. 13884471.7 and of corresponding international PCT application No. PCT/CN2013/089257, dated Jun. 1, 2016.

* cited by examiner

INK CARTRIDGE CHIP, INK CARTRIDGE, AND STRUCTURAL BODY

CROSS-REFERENCE TO RELATED APPLICATIONS

This application is a continuation of International Application No. PCT/CN2013/089257, filed on Dec. 12, 2013, which claims the priority benefit of China Patent Application No. 201310186055.1, filed on May 17, 2013. The contents of the above identified applications are incorporated herein by reference in their entireties.

TECHNICAL FIELD

The present invention relates to the technique of an ink jet printer, and more particularly to an ink cartridge chip, an ink cartridge and a structural body.

BACKGROUND

An ink jet printer is a kind of common office equipment, and usually adopts detachable ink jet ink cartridges. The ink jet ink cartridge is loaded on the body of the ink jet printer, so that the ink can be transferred on a recording medium to form a text or an image. In order to update information related to an ink cartridge in real time, the ink cartridge is usually provided with an ink cartridge chip for storing the information related to the ink cartridge, such as ink quantity, ink type, a manufacturing date of the ink cartridge, etc.

Generally, the ink cartridge chip is provided with a storage medium for storing information and a plurality of contacts connected to the storage medium, the plurality of contacts will contact the stylus on the printer side after the ink cartridge is mounted to the printer, so as to establish an electrical connection between the ink cartridge chip and the printer.

In general, there are 7 or 9 styluses on the printer side, with a distribution mode of 3 up 4 down or 4 up 5 down, and accordingly, as shown in FIG. 1, a plurality of contacts 10 on the ink cartridge chip 1 also can adopt the above arrangement mode of the stylus. The contacts on the ink cartridge chip are usually provided on a side of the ink cartridge chip facing upward and with a larger surface area, and since the area of each contact is small relative to the surface area of the surface on which the contact is located, the above arrangement mode of the contacts not only requires a higher contact left-right positioning accuracy, but also a higher contact up-down positioning accuracy. Accordingly, when the ink cartridge is mounted to the printer, it is difficult to ensure that the contacts on the ink cartridge chip have a good contact with the stylus of the printer.

SUMMARY

The present invention provides an ink cartridge chip, an ink cartridge and a structural body, in order to solve the defect in the prior art that it is difficult to ensure that the contacts on the ink cartridge chip have a good contact with the stylus of the printer.

One aspect of the present invention provides an ink cartridge chip, detachably mounted on an ink cartridge or a structural body, wherein the ink cartridge or the structural body is detachably mounted on an ink jet printer, and the ink cartridge chip includes:

a circuit board that includes a first plane and a second plane perpendicularly intersecting with the first plane, and the surface area of the second plane is smaller than the surface area of the first plane; and a plurality of container side terminals that is disposed on the second plane, one end of each of the container side terminals intersects with the first plane, and the other end of each of the container side terminals intersects with a third plane, the third plane is opposite to the first plane, and the container side terminals are in contact with apparatus side terminals.

Further, when the ink cartridge chip is mounted on the ink cartridge or the structural body, the second plane is parallel to an inserting direction along which the ink cartridge or the structural body is inserted into the ink jet printer.

Another aspect of the present invention provides an ink cartridge, detachably mounted on an ink jet printer, and including the ink cartridge chip according to any of the above items.

Still another aspect of the present invention provides a structural body, detachably mounted on an ink jet printer, and including a chamber for accommodating an ink cartridge and the ink cartridge chip according to any of the above items.

From the above technical solutions, in the ink cartridge chip, the ink cartridge and the structural body provided according to the present invention, the container side terminals are disposed on the second plane with a smaller surface area of the circuit board, and the container side terminals extend through the second plane and are arranged into a row, so that each container side terminal has a reduced positioning accuracy requirement, thereby the apparatus side terminals easily contact the container side terminals, improving the stability of an electrical connection between the ink cartridge and the printer.

Description of reference signs is as follows:

| | | |
|---|---|---|
| 1 - ink cartridge chip | 10 - contact | 200 - ink cartridge chip |
| 201 - circuit board | 202 - container side terminal | 203 - first plane |
| 204 - second plane | 301 - groove | 302 - memory |
| 400 - ink cartridge | 401 - container body | 402 - ink outlet port |
| 403 - mounting groove | 500 - apparatus side terminal | 501 - smooth area |
| 502 - contact area | 5031 - contact-forming part | 510 - contact mechanism |
| 700 - structural body | 701 - chamber | 702 - mounting groove |

DESCRIPTION OF EMBODIMENTS

Embodiment 1

This embodiment provides an ink cartridge chip applicable to an ink cartridge, and especially applicable to an ink cartridge of an ink jet printer. The ink cartridge chip in this embodiment can be detachably mounted on an ink cartridge or a structural body. Wherein, the ink cartridge or the structural body can be detachably mounted on an ink jet printer.

Figure 1:
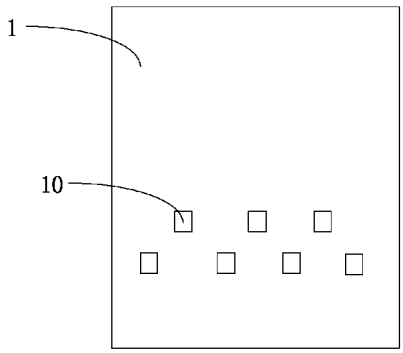
FIG. 1 is a schematic distribution diagram of contacts of an ink cartridge chip in the prior art.
Figure 2:
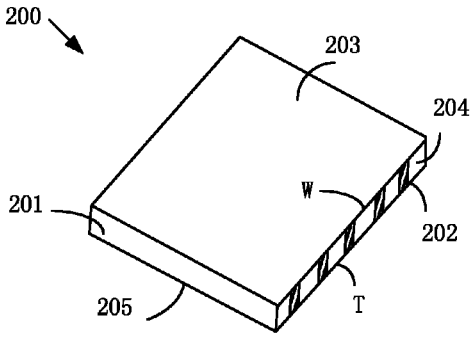
FIG. 2 is a perspective structural schematic diagram of an ink cartridge chip according to an embodiment of the present invention.

FIG. 2 is a perspective structural schematic diagram of the ink cartridge chip according to this embodiment. An ink cartridge chip 200 in this embodiment includes a circuit board 201 and a plurality of container side terminals 202.

Wherein, the circuit board 201 includes a first plane 203 and a second plane 204 perpendicularly intersecting with the first plane 203, and the surface area of the second plane 204 is smaller than the surface area of the first plane 203; each container side terminal 202 is disposed on the second plane 204, one end of each of the container side terminals 202 intersects with the first plane 203, and the other end of each of the container side terminals 202 intersects with a third plane 205, the third plane 205 is opposite to the first plane 203, and the container side terminals 202 are in contact with apparatus side terminals (not shown).

The circuit board 201 in this embodiment can be used to support various components, such as a capacitor and a resistor. Each of the container side terminals 202 in this embodiment specifically can be a contact, and the container side terminals 202 may be rectangular, and particularly may be metallic sheets made of a conductive material. The apparatus side terminal particularly may be a stylus on the printer.

Optionally, the second plane 204 may be rectangular, the longest edges W and T of the second plane 204 are the first boundary line of the first plane 203 and the second plane 204 and the second boundary line of the second plane 204 and the third plane 205, respectively. Then, obviously, one end of each of the container side terminals 202 intersects with the first boundary line, and the other end thereof intersects with the second boundary line.

Optionally, when the ink cartridge chip is mounted on the ink cartridge or the structural body, the second plane 204 is parallel to an inserting direction along which the ink cartridge or the structural body is inserted into the ink jet printer.

In the ink cartridge chip 200 according to this embodiment, the container side terminals 202 are disposed on the second plane 204 with a smaller surface area of the circuit board 201, and the container side terminals 202 extend through the second plane 204 and are arranged into a row, so that each container side terminal 202 can have a reduced positioning accuracy requirement, thereby the apparatus side terminals easily contact the container side terminals, improving the stability of an electrical connection between an ink cartridge and a printer. Moreover, since it only needs to arrange a row of container side terminals on the ink cartridge chip 200, the process above is simple and the cost is relatively low, compared to the case that each of the container side terminals is arranged at an accurate position of the ink cartridge chip 200.

Embodiment 2

This embodiment provides an ink cartridge chip on the basis of Embodiment 1.

Figure 3A:
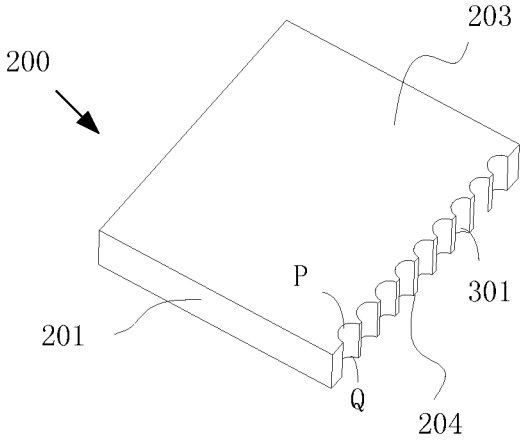
FIG. 3A is a perspective structural schematic diagram of an ink cartridge chip according to another embodiment of the present invention.
Figure 3B:
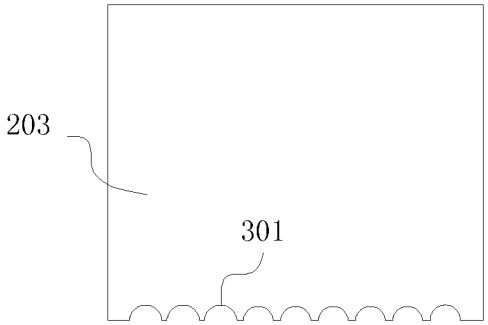
FIG. 3B is a top-view structural schematic diagram of an ink cartridge chip according to another embodiment of the present invention.
Figure 3C:
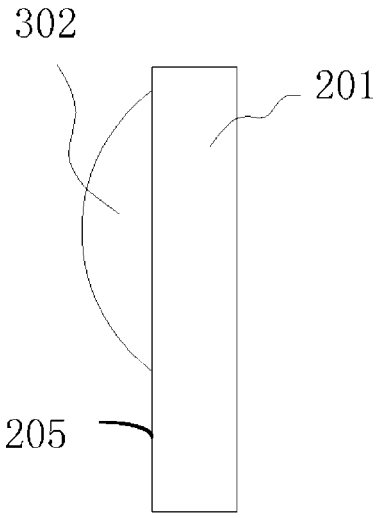
FIG. 3C is a left-view structural schematic diagram according to another embodiment of the present invention.
Figure 3D:
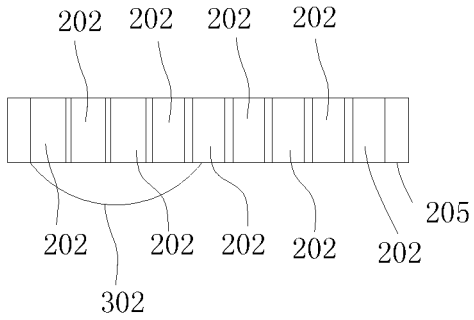
FIG. 3D is a schematic diagram of a second plane of an ink cartridge chip according to another embodiment of the present invention.

FIG. 3A is a perspective structural schematic diagram of the ink cartridge chip 200 according to this embodiment; FIG. 3B is a top-view structural schematic diagram of the ink cartridge chip 200 according to this embodiment; FIG. 3C is a left view of the ink cartridge chip 200 according to this embodiment; and FIG. 3D is a schematic diagram of the second plane 204 of the ink cartridge chip 200 according to this embodiment.

The second plane 204 of the ink cartridge chip 200 in this embodiment includes multiple grooves 301, each groove 301 is provided with one container side terminal 202, that is, the number of grooves 301 is consistent with the number of container side terminals 202, and of course, the number of grooves 301 also may be more than or less than the number of container side terminals 202. In particular, the container side terminals 202 may cover the whole inner surface of the groove 301 where the container side terminals 202 are located.

Optionally, each groove 301 extends through the second plane 204, that is, one end P of the groove 301 intersects with the first plane 203, and the other end Q thereof intersects with the third plane 205.

Optionally, the ink cartridge chip 200 in this embodiment further includes a memory 302 shown in FIG. 3C, for storing the information related to the ink cartridge where the ink cartridge chip 200 is located, such as ink quantity, ink type, and manufacturing date and manufacturer information of the ink cartridge, and the memory 302 particularly may be various storage media, such as EEPROM, RAM, SRAM, Flash and FRAM. The memory 302 is connected to at least one of the container side terminals 202.

The groove 301 in this embodiment may be of a circular arc shape, such as semicircle, that is, the groove 301 has a semicircular projection on the first plane 203. Furthermore, the groove 301 also can be configured to be other shape with a cross-section, such as triangular, rectangular or trapezoid cross-section, and the specific design depends on actual requirements, as long as the apparatus side terminal can be accommodated.

In the ink cartridge chip 200 in this embodiment, the second plane 204 is provided with the groove 301 capable of clamping the apparatus side terminal, so as to restrict movement of the apparatus side terminal, and when the ink cartridge moves rapidly in the printer, displacement of the apparatus side terminal can be reduced, so that the apparatus side terminal and the container side terminal 202 keep contact with each other as much as possible.

Embodiment 3

This embodiment will further describe the ink cartridge chip of the above embodiments. This embodiment provides an ink cartridge including the ink cartridge chip according to any of the above embodiments.

Figure 4:
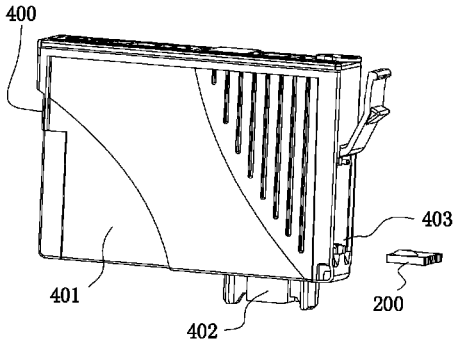
FIG. 4 is a structural schematic diagram of an ink cartridge according to still another embodiment of the present invention.

FIG. 4 is a structural schematic diagram of the ink cartridge according to this embodiment. The ink cartridge 400 may be detachably mounted on an ink jet printer, and includes a container body 401, an ink outlet port 402 and the ink cartridge chip 200.

Wherein, a chamber (not shown) for accommodating ink is formed inside the container body 401, the ink outlet port 402 is provided on the bottom wall of the container body 401, and when the ink cartridge 400 is mounted to the printer, an ink supply needle of the printer can be inserted into the ink outlet port 402, to transfer ink in the chamber of the container body 401 to the printer. The ink cartridge chip 200 in this embodiment may be consistent with that in Embodiment 1 or 2, their description will not repeated again here, and the ink cartridge chip 200 in Embodiment 2 is taken as an example to be described in detail in this embodiment.

Optionally, the ink outlet port 402 is provided with a sealing member (not shown), which may be various devices with a good sealing property, such as a valve mechanism and a welding membrane. For example, the sealing member is a silicon rubber self-closing sealing ring. Since the silicon rubber has good elasticity, the pierced portion of the self-closing sealing ring by the ink supply needle can recover to the closed state when the ink cartridge 400 is pulled out of the printer, thereby preventing the ink from leaking. In addition, an air inlet port (not shown) may be provided on top of the container body 401, the air inlet port allows the ink cartridge 400 to communicate with the outside atmosphere and supplements the air to the inside of the ink cartridge 400 when the ink is consumed so as to regulate the internal pressure.

A mounting groove 403 also may be provided on the side wall of the ink cartridge 400, for containing the ink cartridge chip 200. More specifically, when the ink cartridge chip 200 is mounted into the mounting groove 403, each of the container side terminals 202 on the ink cartridge chip 200 is disposed as protruding from the mounting groove 403. Preferably, an extending direction of the mounting groove 403 is perpendicular to an inserting direction along which the ink cartridge 400 is inserted into the ink jet printer, that is, the mounting direction along which the ink cartridge chip 200 is mounted to the ink cartridge 400 is perpendicular to the above inserting direction. That is to say, at this time, the second plane 204 of the ink cartridge chip 200 is parallel to the above inserting direction of the ink cartridge 400, namely, a surface of the ink cartridge chip 200 with the container side terminals 202 provided on the surface is parallel to the above inserting direction of the ink cartridge 400.

Figure 5A:
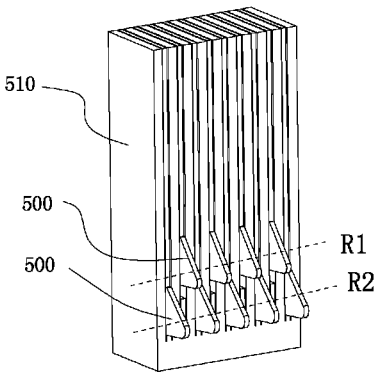
FIG. 5A is a schematic diagram of a contact mechanism where apparatus side terminals at an ink cartridge applicable printer side are located according to still another embodiment of the present invention.
Figure 5B:
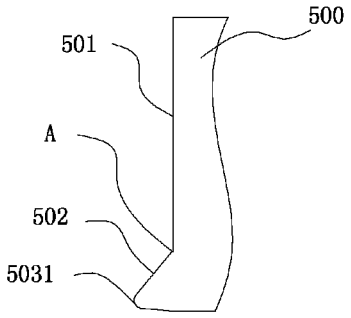
FIG. 5B is a structural schematic diagram of a single apparatus side terminal according to still another embodiment of the present invention.

FIG. 5A is a schematic diagram of a contact mechanism where apparatus side terminals at the ink cartridge 400 applicable printer side is located according to this embodiment, and FIG. 5B is a structural schematic diagram of a single apparatus side terminal.

From FIG. 5A and FIG. 5B, the apparatus side terminals 500 are a ridge-shaped, movable elastic conductive device, and include a smooth area 501 and a contact area 502, and the contact area 502 protrudes with respect to the smooth area 501. In this embodiment, the point where the smooth area 501 meets the contact area 502 is marked with A. In this embodiment, the contact area 502 shows a "Δ" shape. The contact area 502 is provided with a protruding contact-forming part 5031 for contacting the container side terminal, and the contact-forming part 5031 is equivalent to the outermost point in a direction perpendicular to the inserting direction along which the ink cartridge 400 is inserted into the apparatus side terminal 500.

In this embodiment, the contact mechanism 510 is provided with multiple slits with different depths, and each slit is provided with one apparatus side terminal 500, that is, multiple apparatus side terminals 500 are provided on the contact mechanism 510. As shown in FIG. 5B, multiple apparatus side terminals 500 are aligned in two rows R1 and R2 perpendicular to the inserting direction along which the ink cartridge 400 is inserted into the printer at a preset spacing in the inserting direction, and are staggered two by two. The spacing between R1 and R2 may be set as a distance between the contact-forming part 5031 of the apparatus side terminals 500 in row R1 and the contact-forming part 5031 of the apparatus side terminals 500 in row R2.

Figure 6A:
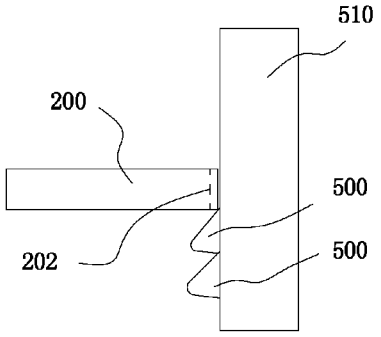
FIG. 6A to FIG. 6C are schematic diagrams of position changes between an ink cartridge chip and an apparatus side terminal, when the ink cartridge is mounted to the printer, according to still another embodiment of the present invention.
Figure 6B:
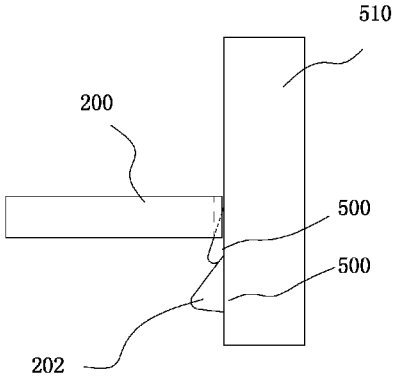
Figure 6C:
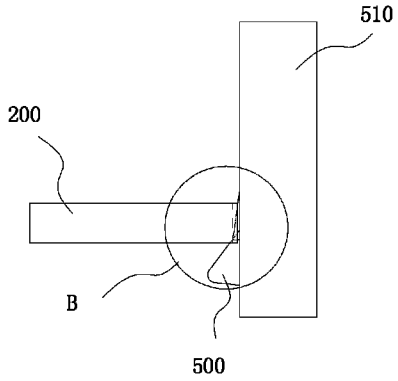
Figure 6D:
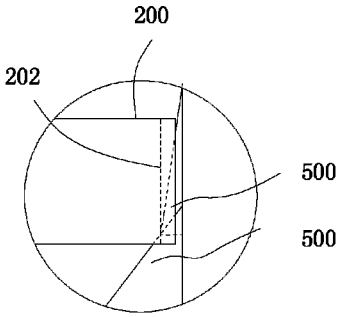
FIG. 6D is an enlarged schematic diagram showing the apparatus side terminal in contact with an container side terminal in FIG. 6C.

FIG. 6A to FIG. 6C are schematic diagrams of position changes between an ink cartridge chip and an apparatus side terminal when the ink cartridge is mounted to the printer, and FIG. 6D is an enlarged schematic diagram showing an apparatus side terminal in contact with an container side terminal in FIG. 6C.

As shown in FIG. 6A, when the ink cartridge 400 is mounted to the printer, the ink cartridge chip 200 is on the upper part of the contact mechanism 510. As the ink cartridge 400 is further mounted, as shown in FIG. 6B, the ink cartridge chip 200 is in contact with the apparatus side terminal 500 in row R1, more specifically, the container side terminal 202 on the ink cartridge chip 200, corresponding to the apparatus side terminal 500 in row R1 is in contact with an area between the contact-forming part 5031 of the apparatus side terminal 500 and the intersecting point A of the smooth area 501 and the contact area 502. Next, as the ink cartridge 400 is further mounted, the ink cartridge chip 200 moves downward and brings the contacted apparatus side terminal 500 moves downward. Since each apparatus side terminal 500 is elastic and movable, it will move within the corresponding slit, that is, the apparatus side terminal 500 in row R1 will be deformed downward as the ink cartridge chip 200 moves downward, and at this time, each groove 301 accommodates a corresponding apparatus side terminal 500, to restrict oscillation of the apparatus side terminal in the left-right direction, and keep the apparatus side terminal 500 in contact with the container side terminal 202 as much as possible, and furthermore, the groove 301 has a function of guiding the apparatus side terminal 500 to move downward or upward. In this way, as the ink cartridge 400 is gradually mounted, the container side terminals 202 on the ink cartridge chip 200 are in contact with the apparatus side terminals 500, respectively, and then a communication is established between the printer and the ink cartridge chip 200, as shown in FIG. 6C and FIG. 6D, and FIG. 6D is an enlarged schematic diagram of area B in FIG.

6C. As shown in FIG. 6C and FIG. 6D, when the apparatus side terminal 500 in row R1 is deformed (moved) downward, since there is an overlapping area between the apparatus side terminal 500 in row R1 and the apparatus side terminal 500 in row R2, when the ink cartridge chip 200 moves to the overlapping area, the apparatus side terminals 500 in row R1 and row R2 are arranged into one row.

As will be appreciated by persons skilled in the art, there may be no overlapping area between the apparatus side terminals 500 in row R1 and those in row R2, and an electrical connection between the ink cartridge chip 200 and the printer may be established as long as the ink cartridge chip 200 moves to contact both of them.

Optionally, the ink cartridge 400 is also provided with a piezoelectric sensor (not shown) for monitoring ink residual in real time. The sensor is connected to two container side terminals 202 on the ink cartridge chip 200, namely, the sensor is connected to the apparatus side terminal 500 via the two container side terminals 202, and thus is connected to the printer, thereby the sensor is able to receive a driving voltage applied to the printer, the driving voltage may be 42V while the driving voltage of the memory 302 is generally 3.6V. Since there is a great voltage difference between the driving voltage of the piezoelectric sensor and that of the memory 302, if a short circuit between any of the container side terminals for connecting a low voltage of the memory 302 and any of the container side terminals for connecting a high voltage of the piezoelectric sensor occurs, the driving voltage of the piezoelectric sensor will be applied to the memory 302 to cause the memory 302 to be damaged. Therefore, the ink cartridge chip 200 also may be provided with a short-circuit detecting terminal. The short-circuit detecting terminal may be one or more of the container side terminals 202, the short-circuit detecting terminal is in contact with the apparatus side terminal on the printer side, so as to connect with a short-circuit detecting circuit on the printer. The short-circuit detecting terminal can be provided between a low voltage container side terminal and a high voltage container side terminal, short circuit detection between the short-circuit detecting terminal itself and the high voltage container side terminal is used to judge whether there is a risk of short circuit between the high voltage container side terminal and the low voltage container side terminal.

Figure 7:
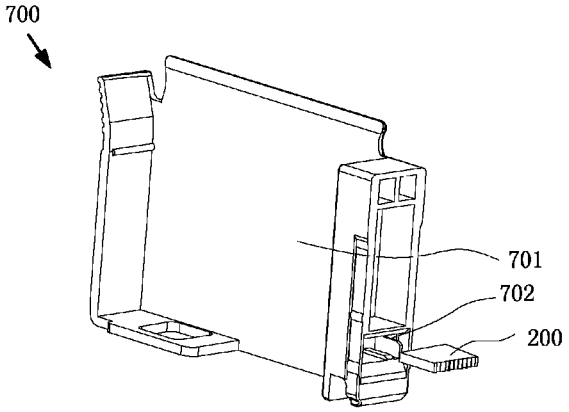
FIG. 7 is a schematic diagram of a structural body according to still another embodiment of the present invention.

Optionally, as shown in FIG. 7, the ink cartridge chip 200 can be provided on a structural body 700, which may be detachably mounted on an ink jet printer and is provided with a chamber 701 for accommodating the ink cartridge. Moreover, the structural body 700 is also provided with a mounting groove 702 for accommodating the ink cartridge chip 200. Obviously, the ink cartridge only acts as a container for storing ink at this time and is not provided with the ink cartridge chip 200. The extending direction of the mounting groove 702 on the structural body 700 is also perpendicular to an inserting direction along which the structural body 700 is inserted into the printer, and the mounting direction of the ink cartridge chip 200 on the structural body 700 is perpendicular to the above inserting direction. That is to say, at this time, the second plane 204 of the ink cartridge chip 200 is parallel to the above inserting direction of the structural body 700, namely, a surface of the ink cartridge chip with the container side terminal 202 provided on the surface is parallel to the above inserting direction of the structural body 700.

Optionally, the structural body 700 may be provided with a reset circuit for resetting ink quantity, and when ink in the ink cartridge is exhausted, the ink quantity in the ink cartridge chip 200 can automatically reset to an initial value, and at this time, the user only needs to replace the ink cartridge or supplement ink to the original ink cartridge. Since the ink cartridge chip 200 is a part with a higher manufacturing cost, the ink cartridge chip 200 connected to the ink cartridge through the structural body 700 can make the same ink cartridge chip 200 applied to multiple ink cartridges, and thus costs can be saved.

Optionally, the ink cartridge or the structural body also may be provided with a linkage mechanism (not shown), and one end of the linkage mechanism is connected to the ink cartridge chip 200, and the other end thereof is an operating portion. Accordingly, when the ink cartridge or the structural body is not in use, the ink cartridge chip 200 is located in the mounting groove 702; when the ink cartridge or the structural body is in use, the operating portion operates accordingly to make the ink cartridge chip 200 located in the mounting groove 702 protrude from the mounting groove 702 and thus contact with the container side terminal at the printer side; when it needs to take out the ink cartridge 400, the operating portion operates to retract the ink cartridge chip 200 into the mounting groove and a pulling-out action is then executed.

Finally, it should be appreciated that the above embodiments are merely provided for describing the technical solutions of the present invention, but not intended to limit the present invention. It should be understood by persons skilled in the art that although the present invention has been described in detail with reference to the foregoing embodiments, modifications can be made to the technical solutions described in the foregoing embodiments, or equivalent replacements can be made to some technical features in the embodiments; however, such modifications or replacements do not cause the essences of corresponding technical solutions to depart from the scope of the embodiments of the present invention.

What is claimed is:

1. An ink cartridge chip to be detachably mounted on an ink cartridge or a structural body, with the ink cartridge or the structural body to be detachably mounted on an ink jet printer, the structural body is provided with a chamber for accommodating the ink cartridge and a mounting groove for accommodating the ink cartridge chip, wherein the ink cartridge chip comprises:

a circuit board comprising a first plane and a second plane perpendicularly intersecting with the first plane, wherein the surface area of the second plane is smaller than the surface area of the first plane; and multiple container side terminals disposed on the second plane, wherein one end of each of the container side terminals intersects with the first plane, and the other end of each of the container side terminals intersects with a third plane, the third plane is opposite to the first plane, and the container side terminals are in contact with apparatus side terminals.

2. The ink cartridge chip according to claim 1, wherein, when the ink cartridge chip is mounted on the ink cartridge or the structural body, the second plane is parallel to an inserting direction along which the ink cartridge or the structural body is inserted into the ink jet printer.

3. The ink cartridge chip according to claim 2, wherein, the container side terminals are rectangular.

4. The ink cartridge chip according to claim 3, wherein, one end of each of the container side terminals intersects with a first boundary line, and the other end of each of the container side terminals intersects with a second boundary line, the first boundary line is a boundary line of the first plane and the second plane, and the second boundary line is a boundary line of the second plane and the third plane.

5. The ink cartridge chip according to claim 2, wherein, the second plane is provided with multiple grooves, each of the grooves is provided with one container side terminal.

6. The ink cartridge chip according to claim 5, wherein, the container side terminal covers the entire inner surface of the groove where the container side terminal is located.

7. The ink cartridge chip according to claim 6, wherein, the groove is in a circular arc shape.

8. The ink cartridge chip according to claim 1, wherein, the second plane is rectangular, the longest edges of the second plane are the boundary line of the first plane and the second plane and the boundary line of the second plane and the third plane, respectively.

9. The ink cartridge chip according to claim 1, further comprising:

a memory disposed on the third plane and connected to at least one container side terminal, for storing information of the ink cartridge where the ink cartridge chip is located.

10. The ink cartridge detachably mounted on an ink jet printer, comprising the ink cartridge chip according to claim 1.

11. The ink cartridge according to claim 10, wherein, the second plane of the ink cartridge chip is parallel to an inserting direction along which the ink cartridge is inserted into the ink jet printer.

12. The structural body detachably mounted on an ink jet printer, comprising a chamber for accommodating an ink cartridge and the ink cartridge chip according to claim 1.

13. The structural body according to claim 12, wherein, the second plane of the ink cartridge chip is parallel to an inserting direction along which the structural body is inserted into the ink jet printer.

14. The ink cartridge chip according to claim 1, wherein, the apparatus side terminals are a ridge-shaped, movable elastic conductive device, and include a smooth area and a contact area, and the contact area protrudes with respect to the smooth area.

15. The ink cartridge chip according to claim 1, wherein, the apparatus side terminals are aligned in two rows perpendicular to an inserting direction along which the ink cartridge is inserted into the printer at a preset spacing in the inserting direction, and are staggered two by two.

* * * * *